US006195939B1

(12) United States Patent
Sowers

(10) Patent No.: US 6,195,939 B1
(45) Date of Patent: Mar. 6, 2001

(54) PIVOT SPRING AUTOMATIC DOOR SEALING APPARATUS

(76) Inventor: David A. Sowers, 4411 NW. 105th Ter., Coral Springs, FL (US) 33065

( * ) Notice: Subject to any disclaimer, the term of this patent is extended or adjusted under 35 U.S.C. 154(b) by 0 days.

(21) Appl. No.: 09/054,607

(22) Filed: Apr. 3, 1998

(51) Int. Cl.[7] ..... E06B 7/20
(52) U.S. Cl. ..... 49/310; 49/307
(58) Field of Search ..... 49/306, 307, 308, 49/310, 311, 312, 303, 304, 305

(56) References Cited

U.S. PATENT DOCUMENTS

| | | | | |
|---|---|---|---|---|
| 483,995 | | 10/1892 | Delancy | 49/307 |
| 799,475 | | 9/1905 | Learned | 49/307 |
| 1,697,408 | | 1/1929 | Thompson | 49/310 |
| 2,033,241 | | 3/1936 | Hawk | 20/67 |
| 2,062,229 | | 11/1936 | Lewis | 49/308 |
| 2,199,860 | | 5/1940 | Rogers et al. | 49/308 |
| 2,433,331 | | 12/1947 | Beck | 20/68 |
| 3,250,314 | | 5/1966 | Wetzel | 160/40 |
| 3,703,788 | | 11/1972 | Rivers | 49/307 |
| 3,871,133 | | 3/1975 | Ellingson, Jr. | 49/308 |
| 4,406,088 | | 9/1983 | Berndt, Jr. | 49/309 |
| 4,425,738 | | 1/1984 | Christensen | 49/310 |
| 4,805,345 | * | 2/1989 | Ohi | 49/310 |
| 4,947,584 | | 8/1990 | Wexler | 49/307 |
| 5,454,192 | * | 10/1995 | Adler et al. | 49/310 X |
| 5,642,588 | * | 7/1997 | Sowers | 49/310 X |

* cited by examiner

*Primary Examiner*—Jerry Redman

(57) ABSTRACT

A sealing apparatus for use with a door which swings over a threshold and has a door lower end, a door face and a door frame, for closing the gap between the door lower end and the threshold, includes a mechanism mounting member; a substantially horizontal gate member for closing the gap; a slide bar positioned above and substantially parallel with the gate member, the slide bar having a protruding end extending laterally from the door toward the door frame to abut the door frame as the door is closed; structure for guiding the slide bar to move laterally relative to the door and to the mounting member; a leaf spring having a leaf spring first end and a leaf spring second end and a leaf spring central segment, the leaf spring first end being engagingly fitted to the slide bar and the leaf spring second end being engagingly fitted to the gate member, where the leaf spring central segment is resiliently pivotable upwardly and laterally to vertically displace the gate member relative to the slide bar; structure for guiding the gate member to move up and down relative to the door; so that closing the door causes the door frame to depress the slide bar protruding end, thereby sliding the slide bar horizontally in one lateral direction and causing the leaf spring to pivot to an increasingly vertical orientation and to thereby lower the attached gate member to make sealing contact with the threshold.

17 Claims, 4 Drawing Sheets

50
52
60
62
66
68
72
20
22
24
26
28
42
44
56
58

PIVOT SPRING AUTOMATIC DOOR SEALING APPARATUS

BACKGROUND OF THE INVENTION

1. Field of the Invention

The present invention relates generally to the field of devices which close the space between the lower end of a closed door and the door threshold to prevent air from passing underneath the door. More specifically the present invention relates to a door lower end sealing apparatus including a gate member which is automatically raised through horizontal movement of a slide bar by opening the door to permit the door to swing freely, and which is automatically lowered by closing the door to seal the space between the threshold and the lower end of the door while the door is closed. A series of leaf springs interconnect the gate member and the slide bar, each leaf spring having a circular loop segment at its upper end and its lower ends. The lower loop segment is snugly fitted into a circular notch in the gate member upper surface and each spring angles upwardly and laterally and is engagingly fitted into a slide bar circular notch in the lower surface of the slide bar. The slide bar is mounted on an upright mounting member and constrained to slide horizontally only, and the gate member is mounted to the mounting member and constrained to slide vertically only.

Closing the door causes the door frame to depress a protruding end of the slide bar. This action slides the slide bar horizontally in one lateral direction and causes the middle segments of the pivot springs to swing vertically upright against biasing of the springs, increasing the vertical extent of the springs and thereby separating the slide bar and gate member so that the gate member advances downwardly into contact with the floor at the point at which the door reaches a fully closed position. Opening the door permits the lateral resilient force of the pivot leaf springs to drive the slide bar in the other lateral direction so that the protruding end once again protrudes from the side of the door. The leaf springs pivot horizontally into their initial angled position, lifting the gate member into its non-sealing position. The apparatus may be mounted on a lower face of the door or within the door lower end.

2. Description of the Prior Art

There have long been sealing devices for closing the gap between the lower end of a door and the threshold, to prevent the passage of heated or cooled air for savings in energy costs. These devices have generally been complex and expensive to manufacture.

One such prior device is that of Beck, U.S. Pat. No. 2,433,331, issued on Dec. 30, 1947. Beck teaches a door bottom closing and sealing device contained within a channel structure which is secured to the lower end of a door. Beck includes a channel structure containing a sealing gate which is loosely suspended from a horizontal spring member. One end of the spring member is fixed and the other end protrudes laterally from the door. When the door is opened, the elastic memory of the spring member straightens the spring member and thereby raises and holds the sealing gate in an elevated position. When the door is closed, the door frame abuts and depresses the spring member protruding end and thus bows the spring member downwardly, lowering the attached sealing gate into contact with the floor. A problem with Beck is that the single holding point, free swinging sealing gate might rattle within the channel structure, making the door seem rickety. Another problem is that the loose suspension of the sealing gate makes the apparatus sloppy, weak and prone to failure.

Wexler, U.S. Pat. No. 4,947,584, issued on Aug. 14, 1990, discloses an automatic door bottom. A downward opening horizontal channel member is provided at the base of a door and contains a drop bar for making sealing contact with the floor. A push rod protrudes laterally from the door and is depressed by the door frame when the door is closed. Depressing the push rod causes a horizontal spring member much like that of Beck to bow downwardly, thereby lowering the attached drop bar. Magnets cause one end of the drop bar to descend before the other. The resilient action of the spring member raises the drop bar off the floor when the door is opened, and the push rod is freed to again protrude. The problems of Beck are again presented.

Christensen, U.S. Pat. No. 4,425,738, issued on Jan. 17, 1984, teaches an automatic threshold seal for a door. Christensen is just another downwardly bowing axially compressed leaf spring structure with a protruding end and a suspended gate; as is Rivers, U.S. Pat. No. 3,703,788, issued on Nov. 28, 1972, which discloses an automatic door bottom; and Ellingson, Jr., U.S. Pat. No. 3,871,133, issued on Mar. 18, 1975, which teaches a door bottom weather sealing structure.

Berndt, Jr., U.S. Pat. No. 4,406,088, issued on Sep. 27, 1983, reveals a door bottom sealing apparatus. Berndt, Jr. includes an inverted channel member secured to the inner face of a door, at the bottom end of the door. A sealing member is pivotally retained within the channel member by a series of hanger linkages secured at their lower ends to the sealing member and at their upper ends to the channel member. Torsion springs bias the sealing member into an upward and laterally displaced position such that an end of the sealing member protrudes toward the door jamb. Closing the door depresses the protruding end of the sealing member and thereby pivots the sealing member downwardly on the hanger linkages to make contact with the floor. Opening the door frees the protruding end so that the torsion springs pivot the sealing member back to its elevated rest position. A problem with Berndt, Jr. is that the protruding end of the sealing member moves a pre-set, fixed distance when depressed and thus lowers the sealing member a constantly repeating fixed distance. Should some object obstruct the lowering of the sealing member, the closing of the door could damage the apparatus. Another problem is that the sealing member moves laterally as well as downwardly, making abrading sliding contact with the floor.

Ohi, U.S. Pat. No. 4,805,345, issued on Feb. 21, 1989 teaches a sealing device for a door. Ohi includes a drive bolt with a protruding end, and a pivoting linkage connected to the drive bolt and to a sealing gate. Closing the door depresses the protruding end and pivots the linkage to lower the sealing gate into contact with the floor. The distance the drive bolt is moved upon closing of the door is adjustable by rotating a tubular screw at the drive bolt protruding end. Despite this adjustability, the unexpected presence of an object below the door could cause damage, as indicated above for Berndt, Jr. Ohi is also relatively complex and expensive to manufacture.

Wetzel, U.S. Pat. No. 3,250,314, issued on May 10, 1966, discloses a seal for a folding partition, recessed into a channel within a door lower end. As disclosed in Berndt, Jr. and in Ohi, a sealing member is suspended from downwardly pivoting hanger linkages and lowered by action of a protruding bolt assembly. The problems of Berndt, Jr. are again presented.

Hawk, U.S. Pat. No. 2,033,241, issued on Mar. 10, 1936, reveals an automatic weather strip for preventing passage of rain, dust and hot or cold air beneath a door or window. The Hawk design is unusual in that no laterally protruding bolt assembly is provided. Instead a series of camming ramps are secured to the threshold beneath the door closed position. Vertical lift rods protrude down through the bottom of the door to ride up on these ramps when the door is closed, against the biasing of coil springs around the rods. An arm protrudes laterally from each rod toward a face of the door, and is connected to a pivoting sealing strip protruding out through a slot in the lower face of the door. Riding up on the ramps as the door closes lifts the rods, the arms and the inner edge of the sealing strip, pivoting the outer edge of the sealing strip downwardly into sealing contact with the threshold. A problem with Hawk is that the pivoting sealing strip structure is relatively delicate, and it could be damaged by abrupt contact with an obstacle in the path of the door. Another problem is that the downwardly protruding rods might touch and scratch the floor as the door swings.

It is thus an object of the present invention to provide a door sealing apparatus which automatically closes the gap between the door lower end and the threshold each time the door is closed.

It is another object of the present invention to provide such an apparatus which biases but does not force a sealing gate member toward a sealing position, so that an obstruction on the floor or threshold does not damage the apparatus.

It is still another object of the present invention to provide such an apparatus with a sealing gate member which cannot slide laterally during lowering and raising to minimize sliding and abrading contact with the threshold.

It is finally an object of the present invention to provide such an apparatus which is sturdy, simple and reliable in design, and relatively inexpensive to manufacture.

SUMMARY OF THE INVENTION

The present invention accomplishes the above-stated objectives, as well as others, as may be determined by a fair reading and interpretation of the entire specification.

A sealing apparatus is provided for use with a door which swings over a threshold and has a door lower end, a door face and a door frame, for closing the gap between the door lower end and the threshold, including a mechanism mounting member; a substantially horizontal gate member for closing the gap; a slide bar positioned above and substantially parallel with the gate member, the slide bar having a protruding end extending laterally from the door toward the door frame to abut the door frame as the door is closed; structure for guiding the slide bar to move laterally relative to the door and to the mounting member; a leaf spring having a leaf spring first end and a leaf spring second end and a leaf spring central segment, the leaf spring first end being engagingly fitted to the slide bar and the leaf spring second end being engagingly fitted to the gate member, where the leaf spring central segment is resiliently pivotable upwardly and laterally to vertically displace the gate member relative to the slide bar; structure for guiding the gate member to move up and down relative to the door; so that closing the door causes the door frame to depress the slide bar protruding end, thereby sliding the slide bar horizontally in one lateral direction and causing the leaf spring to pivot to an increasingly vertical orientation and to thereby lower the attached gate member to make sealing contact with the threshold, and so that opening the door permits the resilient force of the leaf spring on the slide bar to drive the slide bar in the other lateral direction so that the protruding end once again protrudes from the door, and so that the leaf spring resiliently pivots increasingly away from a vertical orientation into its initial position and to thereby lift the gate member out of sealing contact with the threshold.

The gate member preferably has a gate member notch cut into its upper surface to retain and thereby engagingly fit the leaf spring second end, and the slide bar preferably has a slide bar notch cut into its lower surface to retain and thereby engagingly fit the leaf spring first end. The gate notch and the slide bar notch each preferably have a substantially circular portion and the leaf spring first end preferably has a substantially circular segment snugly fitted into the slide bar notch circular portion and the leaf spring second end has a substantially circular segment snugly fitted into the gate member notch circular portion. The structure for guiding the slide bar preferably includes a slide bar guide fastener extending from the mounting member through a substantially horizontal slot in the slide bar to free the slide bar to move laterally, and to simultaneously constrain the slide bar against substantial upward and downward movement. The structure for guiding the gate member preferably includes a gate member guide fastener extending from the mounting member through a substantially vertical slot in the gate member to free the gate member to move up and down, and to simultaneously constrain the gate member against substantial lateral movement. The slide bar guide fastener preferably has a fastener head which overlaps the horizontal guide slot. The gate member guide fastener preferably has a fastener head which overlaps the vertical guide slot.

The apparatus preferably additionally includes a resilient sealing strip, and a groove is recessed into the lower surface of the gate member for retaining the resilient sealing strip to abut the threshold and obstruct passage of air. The groove and the resilient sealing strip are preferably of T-shaped cross-section to permit the sealing strip to slide axially into and out of the groove for periodic replacement and to prevent the sealing strip from sliding downwardly out of the groove.

The gate member and the slide bar are both preferably retained within an inverted channel-shaped housing with a vertical leg portion, the vertical leg portion constituting the mechanism mounting member. The housing is optionally retained within the door lower end. The housing is preferably secured to the face of the door at the door lower end. The door face optionally constitutes the mechanism mounting member.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
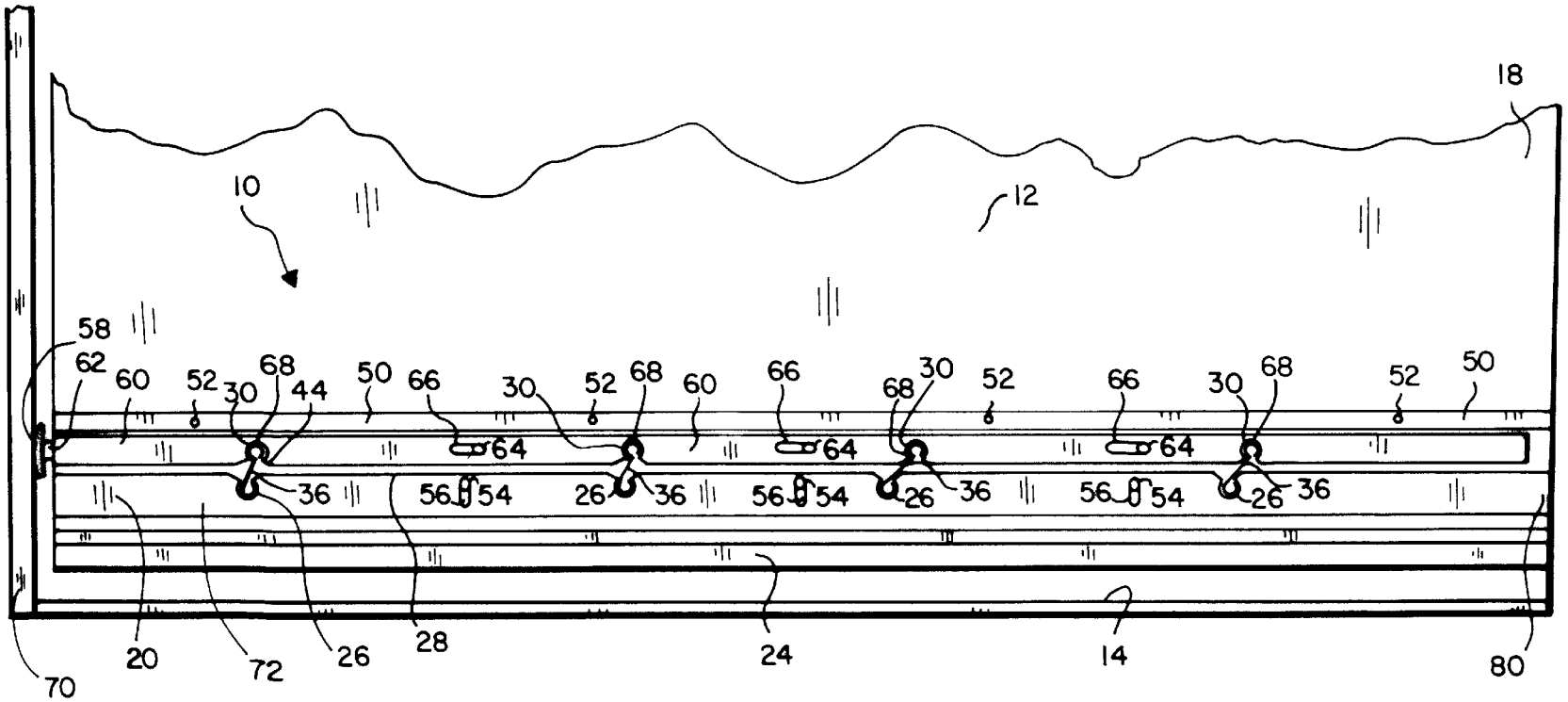
FIG. 1 is a front view of the preferred embodiment of the apparatus fitted to the lower end of a door, with the door in the open position and the sealing strip and gate member retracted.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

Figures 2, 2A, 3, 3A, 4:
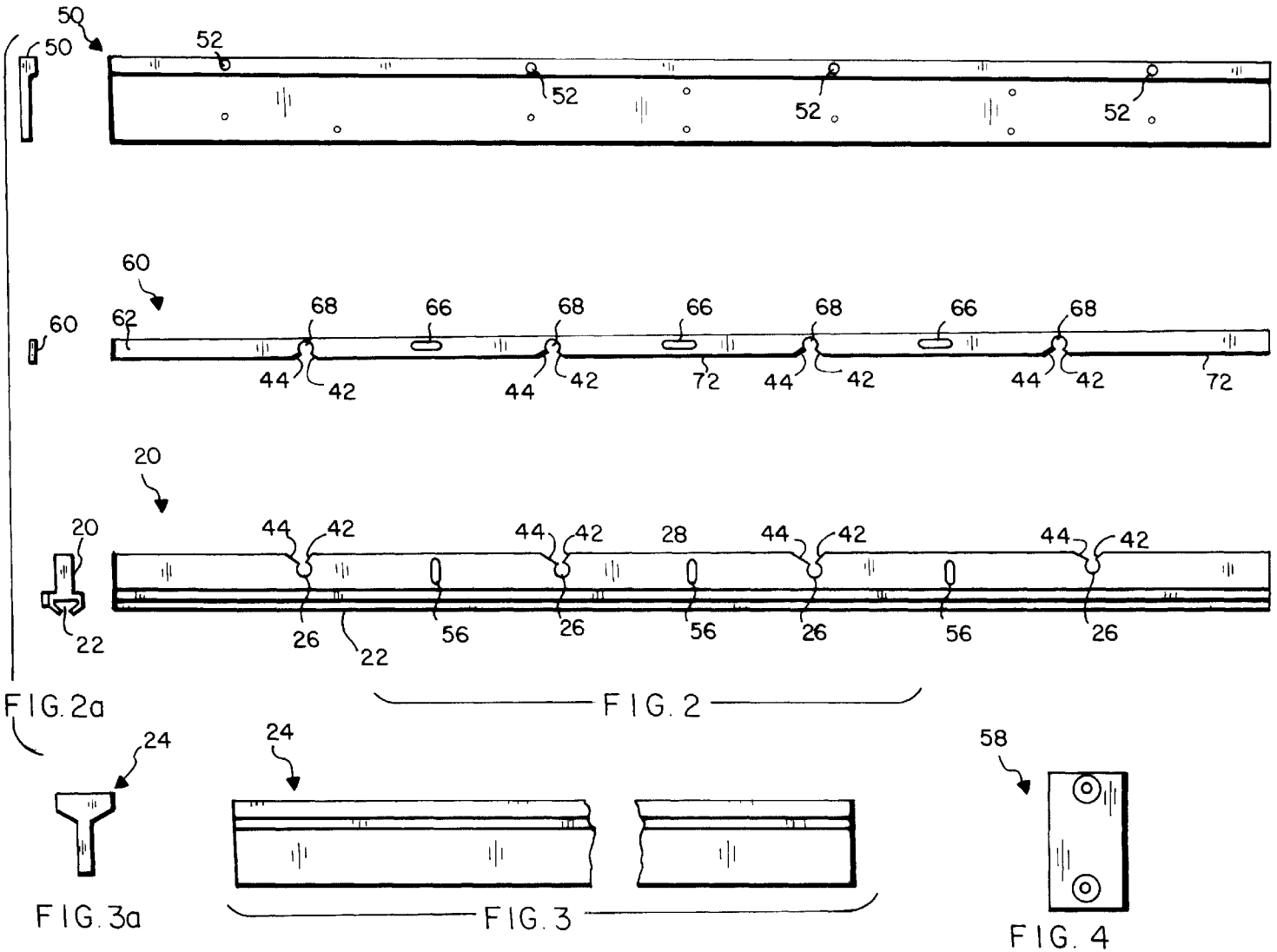
FIG. 2 is a partial exploded view of the apparatus including the mechanism mounting member, the slide bar and the gate member.
FIG. 2*a* shows the side profiles of each respective member shown in FIG. 2.
FIG. 3 is a front view of the preferred sealing strip.
FIG. 3*a* is a side profile of the sealing strip, showing the T-shaped cross-section.
FIG. 4 is a front view of the striker plate.
Figure 5:
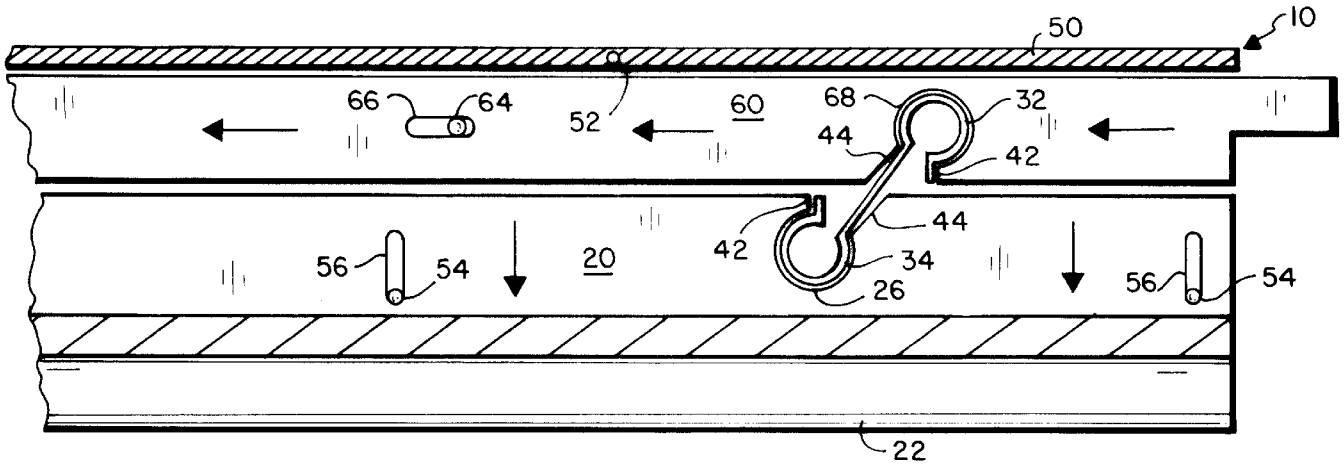
FIG. 5 is a broken away view, close-up view of the slide bar and the gate member in the raised position with the door open. The sealing strip is omitted.
Figure 6:
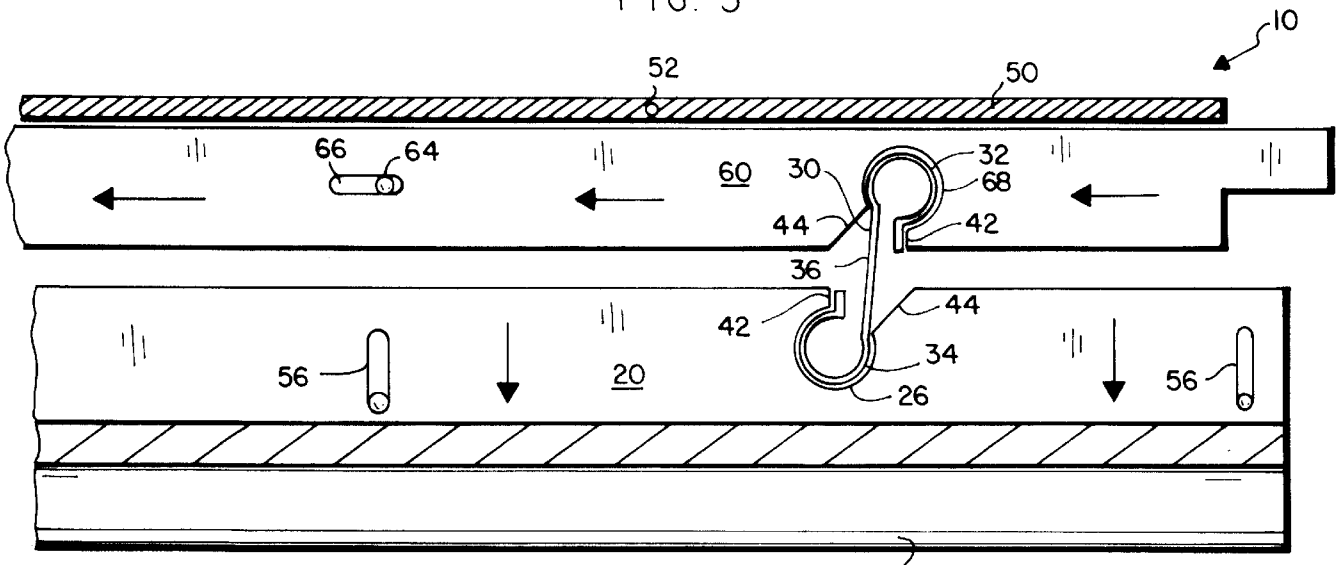
FIG. 6 is a view as in FIG. 5 is with the gate member in the lowered position with the door closed.
Figure 7:
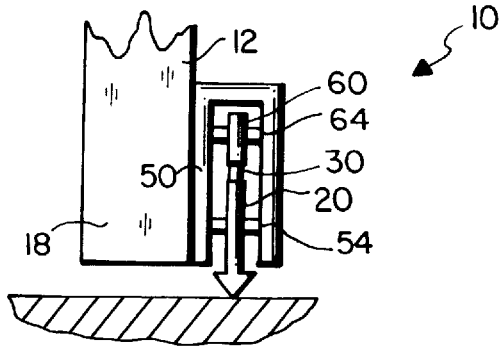
FIG. 7 is a cross-sectional side view of a door lower end having the inverted channel mechanism mounting member and housing secured to its outer face.
Figure 8:
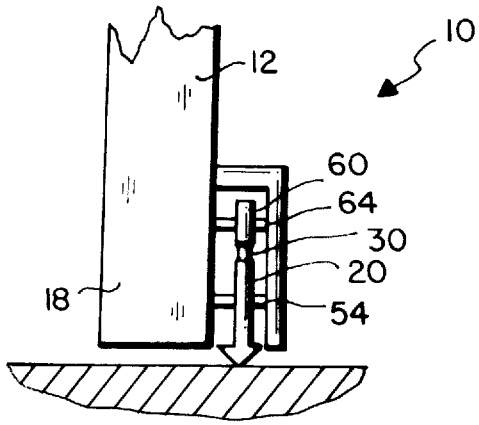
FIG. 8 is a cross-sectional side view of an embodiment of a door lower end having the inverted channel mechanism mounting member and housing wherein the leg portion mounting member is the door outer face.
Figure 9:
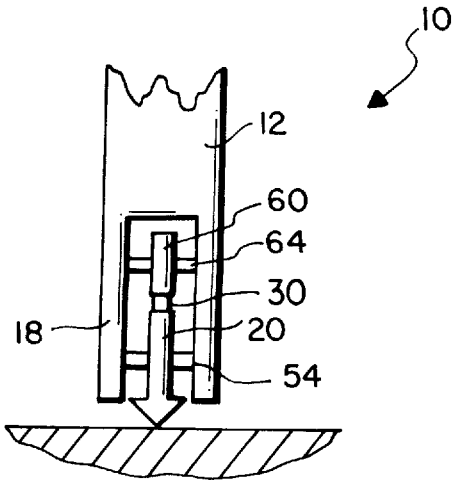
FIG. 9 is a cross-sectional side view of an embodiment of a door lower end having the inverted channel mechanism mounting member and housing wherein the mounting member and housing are retained or defined within the door lower end itself.

Referring to FIGS. 1–6, an apparatus 10 is disclosed for closing the space between a door 12 lower end 18 and the threshold 14 to obstruct the passage of air through the space. Apparatus 10 includes a gate member 20 which is automatically raised by opening the door 12 to permit the door 12 to swing freely, and which is automatically lowered by closing the door 12, to seal the space between the threshold 14 and the door 12 lower end 18 when the door is closed.

Gate member 20 is preferably an elongate slat having a groove 22 recessed into its lower surface for retaining a resilient sealing strip 24 to sealingly abut the threshold 14. Groove 22 and resilient sealing strip 24 are preferably of T-shaped cross-section to permit sealing strip 24 to slide axially into and out of groove 22 for periodic replacement, and at the same time to prevent sealing strip 24 from sliding downwardly out of groove 22. See FIGS. 3 and 3*a*.

A slide bar 60 is positioned above and parallel to gate member 20, and a protruding end 62 of slide bar 60 protrudes laterally from the door 12 to abut the door frame 70 as the door 12 is closed. See FIG. 1. A striker plate 58 is fastened to the door frame 70 for protruding end 62 to strike, to prevent damage to the door frame 70. See FIG. 4.

A series of leaf springs 30 interconnect gate member 20 and slide bar 60, each leaf spring 30 having a circular upper loop segment 32 at its upper end and a circular lower loop segment 34 at its lower end. Each lower loop segment 34 is snugly fitted into a circular gate member notch 26 in the gate member 20 upper surface and each spring 30 angles upwardly and laterally and is engagingly fitted into a circular slide bar notch 68 in the slide bar 60 lower surface 72. See FIGS. 5 and 6. Each leaf spring 30 has a resilient middle segment 36. A spring end tab 38 bears against a first flat face 42 of each notch 26 opening. A second flat face 44 of the notch 26 opening is angled outwardly to provide clearance for the given spring 30 within the notch 26 to pivot.

An upright mounting member 50 is secured to door 12 with roll pins 52. Slide bar 60 is slidably mounted to mounting member 50 and constrained to slide horizontally only, and gate member 20 is slidably mounted to mounting member 50 and constrained to slide vertically only.

Constrained movement is accomplished with guide fasteners 54 which extend from mounting member 50 through vertical guide slots 56 in gate member 20 to free gate member 20 to move up and down, and to simultaneously constrain gate member 20 against lateral movement. Each guide fastener 54 has a fastener head which slidably overlaps the guide slot 56. By the same token, guide fasteners 64 extend from mounting member 50 through horizontal guide slots 66 in slide bar 60 to free slide bar 60 to move laterally, and to simultaneously constrain slide bar 60 against upward and downward movement. Each guide fastener 64 has a fastener head which slidably overlaps the guide slot 66.

Closing the door 12 causes the door 70 frame to depress the slide bar protruding end 62. This action slides slide bar 60 horizontally in one lateral direction and causes leaf spring middle segments 36 to pivot downwardly against spring 30 biasing and thereby lower the attached gate member 20. See FIGS. 5 and 6.

The lowered gate member 20 makes sealing contact with the threshold 14 while the door 12 is closed. Opening the door 12 permits the lateral resilient force of the leaf pivot springs 30 on the notch 68 side walls to drive the slide bar 60 in the other lateral direction so that the protruding end 62 once again protrudes from the side surface of the door 12. The leaf spring middle segments 36 pivot upwardly into their initial position, lifting the gate member 20 into the non-sealing position. See FIGS. 5 and 6.

Gate member 20 and slide bar 60 are both preferably retained within an inverted channel-shaped housing 80, a vertical leg of which constitutes upright mounting member 50. Housing 80 is either retained within the lower end 18 of the door 12 itself, or is secured to a face of the door 12 at the door lower end 18.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. A sealing apparatus comprising:

a door which swings over a threshold between an open position and a closed position and has a door lower end spaced above said threshold and defining a gap between the door lower end and the threshold when the door is in the closed position, and has a door face and a door frame, for closing the gap between the door lower end and the threshold:

a mechanism mounting member;

a substantially horizontal gate member for closing said gap;

a slide bar positioned above and substantially parallel with said gate member, said slide bar having a protruding end extending laterally from the door toward the door frame to abut the door frame as the door is closed;

means for guiding said slide bar to move laterally relative to the door and to said mounting member;

a leaf spring having a leaf spring first end and a leaf spring second end and a leaf spring central segment, said leaf spring first end being engagingly fitted to said slide bar and said leaf spring second end being engagingly fitted to said gate member, wherein said leaf spring central segment is resiliently pivotable upwardly and laterally to vertically displace said gate member relative to said slide bar;

means for guiding said gate member to move up and down relative to the door;

such that closing the door causes the door frame to depress said slide bar protruding end, thereby sliding said slide bar horizontally in one lateral direction and causing said leaf spring to pivot to an increasingly vertical orientation and to thereby lower the attached said gate member to make sealing contact with said threshold, and such that opening the door permits the resilient force of said leaf spring on said slide bar to drive said slide bar in the other lateral direction such that said protruding end once again protrudes from the door, and such that said leaf spring resiliently pivots increasingly away from a vertical orientation into its initial position and to thereby lift said gate member out of sealing contact with said threshold.

2. The apparatus of claim 1, wherein said gate member has a gate member notch cut into its upper surface to retain and thereby engagingly fit said leaf spring second end, and such that said slide bar has a slide bar notch cut into its lower surface to retain and thereby engagingly fit said leaf spring first end.

3. The apparatus of claim 2, wherein said gate notch and said slide bar notch each have a substantially circular portion and wherein said leaf spring first end has a substantially circular segment snugly fitted into said slide bar notch circular portion and said leaf spring second end has a substantially circular segment snugly fitted into said gate member notch circular portion.

4. The apparatus of claim 1, wherein the door face constitutes said mechanism mounting member.

5. A door and sealing apparatus, comprising:

a threshold;

a door mounted to swing over said threshold between an open position and a closed position and having a door lower end spaced above said threshold and defining a gap between the door lower end and the threshold when the door is in a closed position, and having a door face and a door frame, for closing the gap between the door lower end and the threshold;

a mechanism mounting member;

a substantially horizontal gate member for closing said gap;

a slide bar positioned above and substantially parallel with said gate member, said slide bar having a protruding end extending laterally from said door toward said door frame to abut said door frame as said door is closed;

means for guiding said slide bar to move laterally relative to said door and to said mounting member;

a leaf spring having a leaf spring first end and a leaf spring second end and a leaf spring central segment, said leaf spring first end being engagingly fitted to said slide bar and said leaf spring second end being engagingly fitted to said gate member, wherein said leaf spring central segment is resiliently pivotable upwardly and laterally to vertically displace said gate member relative to said slide bar;

means for guiding said gate member to move up and down relative to said door;

such that closing said door causes said door frame to depress said slide bar protruding end, thereby sliding said slide bar horizontally in one lateral direction and causing said leaf spring to pivot to an increasingly vertical orientation and to thereby lower the attached said gate member to make sealing contact with said threshold, and such that opening said door permits the resilient force of said leaf spring on said slide bar to drive said slide bar in the other lateral direction such that said protruding end once again protrudes from said door, and such that said leaf spring resiliently pivots increasingly away from a vertical orientation into its initial position and to thereby lift said gate member out of sealing contact with said threshold.

6. A sealing apparatus comprising:

a door which swings over a threshold between an open position and a closed position and has a door lower end spaced above said threshold and defining a gap between the door lower end and the threshold when the door is in the closed position, and has a door face and a door frame, for closing the gap between the door lower end and the threshold;

a mechanism mounting member;

a substantially horizontal gate member for closing said gap;

a slide bar positioned above and substantially parallel with said gate member, said slide bar having a protruding end extending laterally from the door toward the door frame to abut the door frame as the door is closed;

means for guiding said slide bar to move laterally relative to the door and to said mounting member;

a leaf spring having a leaf spring first end and a leaf spring second end and a leaf spring central segment, said leaf spring first end being engagingly fitted to said slide bar and said leaf spring second end being engagingly fitted to said gate member, wherein said leaf spring central segment is resiliently pivotable upwardly and laterally to vertically displace said gate member relative to said slide bar; and means for guiding said gate member to move up and down relative to the door;

such that closing the door causes the door frame to depress said slide bar protruding end, thereby sliding said slide bar horizontally in one lateral direction and causing said leaf spring to pivot to an increasingly vertical orientation and to thereby lower the attached said gate member to make sealing contact with said threshold, and such that opening the door permits the resilient force of said leaf spring on said slide bar to drive said slide bar in the other lateral direction such that said protruding end once again protrudes from the door, and such that said leaf spring resiliently pivots increasingly away from a vertical orientation into its initial position and to thereby lift said gate member out of sealing contact with said threshold;

wherein said gate member has a gate member notch cut into its upper surface to retain and thereby engagingly fit said leaf spring second end, and such that said slide bar has a slide bar notch cut into its lower surface to retain and thereby engagingly fit said leaf spring first end; and wherein said gate notch and said slide bar notch each have a substantially circular portion and wherein said leaf spring first end has a substantially circular segment snugly fitted into said slide bar notch circular portion and said leaf spring second end has a substantially circular segment snugly fitted into said gate member notch circular portion.

7. The apparatus of claim 6, wherein said gate member has a gate member notch cut into its upper surface to retain and thereby engagingly fit said leaf spring second end, and such that said slide bar has a slide bar notch cut into its lower surface to retain and thereby engagingly fit said leaf spring first end.

8. The apparatus of claim 7, wherein said gate notch and said slide bar notch each have a substantially circular portion and wherein said leaf spring first end has a substantially circular segment snugly fitted into said slide bar notch circular portion and said leaf spring second end has a substantially circular segment snugly fitted into said gate member notch circular portion.

9. The apparatus of claim 6, wherein said means for guiding said slide bar comprises a slide bar guide fastener extending from said mounting member through a substantially horizontal slot in said slide bar to free said slide bar to move laterally, and to simultaneously constrain said slide bar against substantial upward and downward movement.

10. The apparatus of claim 9, wherein said slide bar guide fastener has a fastener head which overlaps said horizontal guide slot.

11. The apparatus of claim 6, wherein said means for guiding said gate member comprises a gate member guide fastener extending from said mounting member through a substantially vertical slot in said gate member to free said gate member to move up and down, and to simultaneously constrain said gate member against substantial lateral movement.

12. The apparatus of claim 11, wherein said gate member guide fastener has a fastener head which overlaps said vertical guide slot.

13. The apparatus of claim 6, additionally comprising a resilient sealing strip, wherein a groove is recessed into the lower surface of said gate member for retaining said resilient sealing strip to abut said threshold and obstruct passage of air.

14. The apparatus of claim 13, wherein said groove and said resilient sealing strip are of T-shaped cross-section to permit said sealing strip to slide axially into and out of said groove for periodic replacement and to prevent said sealing strip from sliding downwardly out of said groove.

15. The apparatus of claim 6, wherein said gate member and said slide bar are both retained within an inverted channel-shaped housing with a vertical leg portion, said vertical leg portion constituting said mechanism mounting member.

16. The apparatus of claim 6, wherein said housing is retained within the door lower end.

17. A sealing apparatus, comprising:

a door which swings over a threshold between an open position and a closed position and has a door lower end spaced above said threshold and defining a gap between the door lower end and the threshold when the door is in the closed position, and has a door face and a door frame, for closing the gap between the door lower end and the threshold;

a mechanism mounting member;

a substantially horizontal gate member for closing said gap;

a slide bar positioned above and substantially parallel with said gate member, said slide bar having a protruding end extending laterally from the door toward the door frame to abut the door frame as the door is closed;

means for guiding said slide bar to move laterally relative to the door and to said mounting member:

a leaf spring having a leaf spring first end and a leaf spring second end and a leaf spring central segment, said leaf spring first end being engagingly fitted to said slide bar and said leaf spring second end being engagingly fitted to said gate member, wherein said leaf spring central segment is resiliently pivotable upwardly and laterally to vertically displace said gate member relative to said slide bar;

means for guiding said gate member to move up and down relative to the door:

such that closing the door causes the door frame to depress said slide bar protruding end, thereby sliding said slide bar horizontally in one lateral direction and causing said leaf spring to pivot to an increasingly vertical orientation and to thereby lower the attached said gate member to make sealing contact with said threshold, and such that opening the door permits the resilient force of said leaf spring on said slide bar to drive said slide bar in the other lateral direction such that said protruding end once again protrudes from the door, and such that said leaf spring resiliently pivots increasingly away from a vertical orientation into its initial position and to thereby lift said gate member out of sealing contact with said threshold;

wherein said gate member and said slide bar are both retained within an inverted channel-shaped housing with a vertical leg portion, said vertical leg portion constituting said mechanism mounting member:

wherein said housing is secured to said face of the door at said door lower end.

* * * * *